United States Patent [19]

Brotchie

[11] 3,935,609

[45] Feb. 3, 1976

[54] SHOE LAST WITH INSOLE HOLDING DEVICES

[75] Inventor: Walter J. Brotchie, Beverly, Mass.

[73] Assignee: USM Corporation, Boston, Mass.

[22] Filed: Sept. 20, 1974

[21] Appl. No.: 507,999

[52] U.S. Cl. ..... 12/128 D

[51] Int. Cl.[2] ..... A43D 3/00

[58] Field of Search ..... 12/128 R, 128 D

[56] References Cited

UNITED STATES PATENTS

| | | | |
|---|---|---|---|
| 1,370,574 | 3/1921 | Wright et al. | 12/128 D |
| 3,744,074 | 7/1973 | Stapleton | 12/128 D |
| 3,833,958 | 9/1974 | Randall | 12/128 D |

*Primary Examiner*—Patrick D. Lawson

*Attorney, Agent, or Firm*—Vincent A. White; Richard B. Megley

[57] ABSTRACT

A shoe last having an insole securing member comprising at least one blade projecting from the last bottom and being undercut to form a hook-like projection which resists dislodging of the insole.

5 Claims, 5 Drawing Figures

SHOE LAST WITH INSOLE HOLDING DEVICES

BACKGROUND AND OBJECTS OF THE INVENTION

In the U.S. Pat. Nos. 3,744,074 and 3,833,958 there are disclosed methods of temporarily attaching insoles to the bottom of lasts as a preliminary step in a sequence of shoemaking operations. Such methods and the lasts used avoid the use of tacks, adhesive tape and the like, or the need for providing apertures in the insoles to receive pins on the last bottom. As disclosed in said patents, the lasts used are provided with at least one locating member having a cutting edge upstanding from the last bottom. In the case of U.S. Pat. No. 3,744,074 the member penetrates the insole to cut a tab in the insole. In U.S Pat. No. 3,833,958 the member has spaced blades which form slits in the insole and by compressing the insole material between the blades resist dislodgement. While such members perform well in holding insoles of many materials it has been found that a variety of insoles of soft materials are not held adequately by such members resulting in occasional dislodgement or misalignment of the temporarily attached insole from the last bottom during the shoe making steps.

Accordingly, it is a general object of the invention to provide shoe lasts having improved holding members for temporarily attaching insoles of any material to last bottoms. To this end the members are provided with at least one blade having one end recessed or undercut to form a hook-like projection which resists accidental dislodgement when the blade is forceably embedded in the insole.

There will now be given with reference to the accompanying drawings a detailed description of a variety of illustrative lasts embodying the invention. It is to be understood, however, that the lasts described are selected for illustration of the invention and not for limitation thereof.

Figure 1:
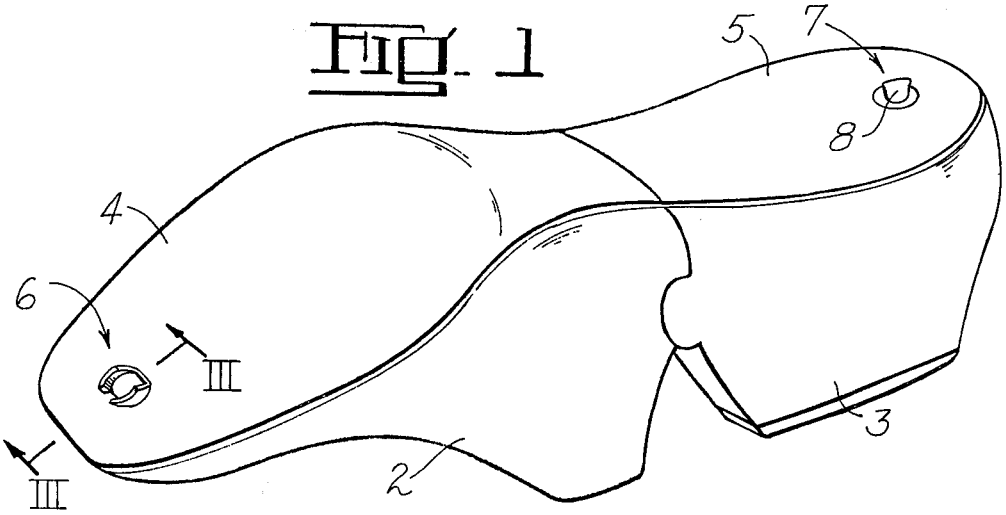
FIG. 1 is a perspective view of a last fitted with an insole holding member embodying the invention.
Figure 3:
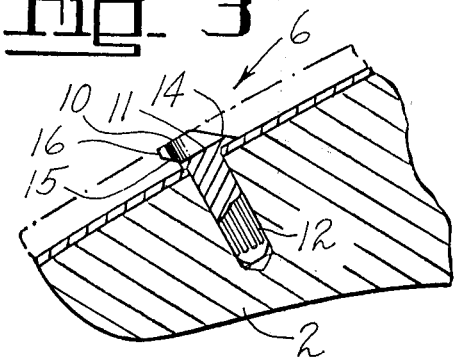
FIG. 3 is a section on line III—III of FIG. 1.

A typical last embodying the invention may be formed in two parts with a forepart portion 2 hinged to a heel part 3 so that the last may be moved between an extended condition shown in FIG. 1 and a broken condition (not shown) to facilitate removal of the last from a completed shoe. Each last may be provided with bottom plates 4 and 5 secured to the forepart and heel part respectively. The last, however, can be formed in one piece without departing from the scope of the invention. The last shown in FIGS. 1 and 3 is provided with forepart locating means indicated generally by the reference numeral 6, upon which a forepart portion of an insole to be secured to the bottom of a last may be impaled. To assist in retaining the insole in the desired position on the last bottom, the last may be provided with a similar member 6 at the heel seat or as seen in FIG. 1 may be provided with a heel seat locating member 7 of another form. The member 7 may be pointed or be a chisel pointed pin 8 which extends upwardly beyond the plate portion 5 of the last bottom in a more or less central position with respect to the heel seat portion. Additional members may be arranged at other portions of the last bottom such, for example, as in the shank area. The pin 8 preferably is so orientated that the chisel edge extends generally lengthwise of the heel seat portion of the last and may be secured by a stem portion (not shown) which is driven into the last through a hole in the plate portion 5.

Figure 2:
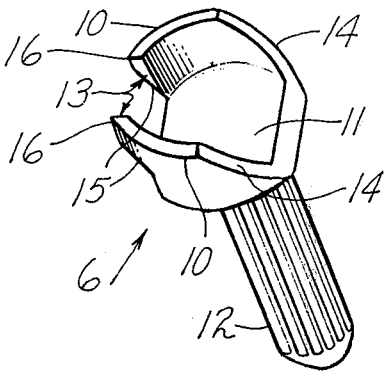
FIG. 2 is an enlarged perspective view of the insole holding member shown in FIG. 1.

The forepart locating means 6 preferably is arranged near the toe end of the last and approximately on the centerline of the forepart. The locating means may comprise two blade-like portions 10 (FIG. 2) upstanding from a single base portion 11 which has a depending stem portion 12 by which it is secured in the last with the base portion 11 against or recessed in the bottom plate 4 with the two blades or portions 10 upstanding from the bottom of the last. As is seen from FIGS. 1 and 2 the blades 10 are arcuate and may be concentric with the stem portion 12. Conveniently, the diameter of the circle may be of the order of 5/16 inch. The blades 10, of course, could be straight and the edges may be blunt rather than sharp without departing from the scope of the invention.

As shown in FIGS. 1 and 3 the forepart locating means 6 is so orientated that the blades 10 extend generally lengthwise of the last. A gap 13, of some ⅛ to 3/16 inch is formed between the adjacent toeward ends of the blades 10 which extend sufficiently far heelwardly for the heelward ends to lie at least substantially upon a common diameter of the circle above referred to. As is shown in the drawings, the heelward ends 14 of the blades are inclined at an angle of some 35° to the last bottom for a purpose hereinafter referred to. The opposite ends of the blades are recessed as at 15 so that a hook-like projection 16 is formed on the ends of the blades. The projections 15 are particularly useful in that after an insole is impaled on the blades the projections are effective in resisting dislodgement of the insole. It has been found that the projections are effective with all types of insole material and that a recess 15 approximately 1/16 inch deep and about 1/32 inch up from the base of the fitting has been particularly effective. The recess may be formed by a straight surface as shown or may be curved to suit various insole materials without departing from the scope of the invention.

Figure 4:
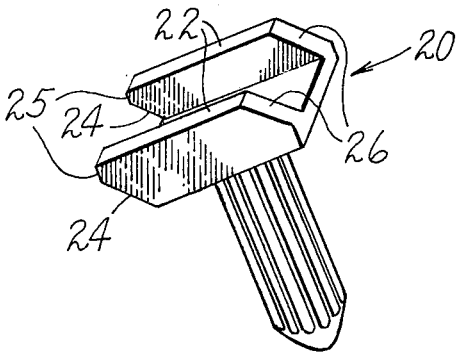
FIG. 4 is a perspective view showing an alternate form of insole holding member.
Figure 5:
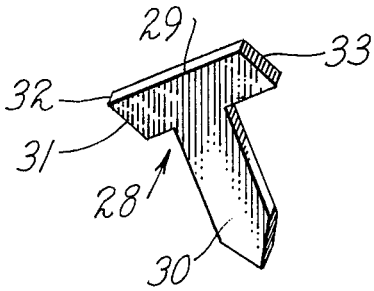
FIG. 5 is a perspective view showing a third alternate form of insole holding member.

Referring to FIG. 4, there is shown an alternate form of locating means 20 having two opposed blades 22 which are straight rather than arcuate as the blades 10 of member 6. The blades 22 at one end have undercuts 24 which are shown as straight surfaces but which may be shaped otherwise and which form projections 25 having the same purpose as the projections 16 of members 6. The other end of the blades 22 are inclined as at 26 to facilitate removal of a completed shoe from the last. Another form of holding member 28 is shown in FIG. 5 and may be formed from flat material. The member 28 comprises a blade 29 having a shank 30 which may be driven into a last so only the blade projects from the last bottom. The blade is undercut at one end at 31 to form a projection 32 and is inclined at the other end at 33 for the same purposes discussed above.

As shown in the drawings the cutting edges of the blades may be relatively blunt and are not therefore likely to be readily damaged during the handling of the lasts. Conveniently, the thickness of the blades may be some 0.025 to 0.030 inch. However, the application of percussive force, as by a hand held hammer or a power operated machine such as described in U.S. Pat. No. 3,772,721 to a forepart portion of the insole may readily cause penetration of the insole by the blades. Preferably, the height of the upstanding blades is less than the thickness of the insoles to be secured so that the blades will not be exposed at the outer surface of the impaled insole. While such a condition is preferable it is not necessary to the effectiveness of the invention. Thus, there are conditions contemplated where the blades would cut through the entire thickness of the insole and be exposed at the outer surface without adverse effects.

In following the general method of temporarily securing an insole as described in said patents, a last is provided with locating means such as 6, 20 or 28 fixed in the last bottom and having the blade portions projecting from the last bottom. The last may be provided with such members in the forepart, shank and/or heel seat. An insole, which may be pre-molded to a shape corresponding to (or exaggerated as compared with) that of the bottom of the last, is positioned against the last bottom accurately with respect to the outline of the last, i.e. in correct alignment with the edge portions thereof. Force is then applied at least to portions of the insole opposite the locating means to impale the insole thereon, the blades of the members being embedded in the thickness of the insole. The force preferably is applied as a percussive force either by the use of a hand held hammer or by the use of a machine like that disclosed in said U.S. Pat. No. 3,772,721. As the blades penetrate the insole, the hook-like projections are embedded in the insole in a manner such that inadvertent displacement of the insole from the locating means during the following shoemaking operations is unlikely to take place.

After the insole has been assembled on the last bottom an upper is placed over the last and the usual shoe making operations are performed, such as lasting and bottoming with a sole member. When it is desired to slip the completed shoe from the last, the last may be broken and the heel end portions of the upper and insole raised from the last bottom. While the hook-like projections resist dislodgement, they do not prevent removal or undue tearing of the insole material. The forepart portion of the shoe is then drawn toewardly off the last, and as the forepart portion of the last is thereby withdrawn from the shoe the inclined heelward end portions 14, 26 or 33 of the forepart locating means lift the forepart of the insole off the blades so that no undue scoring of the insole is likely to take place as the shoe is removed from the last.

Having thus described my invention and what I claim as new and desire to secure as Letters Patent of the United States is:

1. A shoe last having an insole securing member comprising at least one elongated blade projecting substantially normally from the bottom of the last and adapted to cut into and be embedded in an insole forceably applied to the last bottom, said blade having at least one end undercut to form a projection which resists dislodging of the insole.

2. A shoe last according to claim 1 in which the projection is hook-like.

3. A shoe last according to claim 1 in which the blade is elongate and extends generally lengthwise of the last.

4. A shoe last according to claim 1 in which the securing member comprises a pair of said blades extending generally lengthwise of the last and spaced apart widthwise.

5. A shoe last according to claim 1 in which the opposite end of the blade is inclined to facilitate removal of the last from a completed shoe.

* * * * *